United States Patent [19]

Frohlich et al.

[11] 4,099,302

[45] Jul. 11, 1978

[54] SLIDE FASTENER

[75] Inventors: Alfons Fröhlich; Walter Passmann, both of Essen, Fed. Rep. of Germany

[73] Assignee: OPTI Patent- Forschungs- und Fabrikations-AG, Glarus, Switzerland

[21] Appl. No.: 722,048

[22] Filed: Sep. 10, 1976

[30] Foreign Application Priority Data

Sep. 10, 1976 [DE] Fed. Rep. of Germany ..... 2540201
Jun. 19, 1976 [DE] Fed. Rep. of Germany ..... 2627640

[51] Int. Cl.[2] ..... A44B 19/32

[52] U.S. Cl. ..... 24/205.15 R; 24/205.16 C; 139/384 B

[58] Field of Search ..... 139/384 B; 24/205.1 R, 24/205.1 C, 205.15 R, 205.16 C

[56] References Cited

U.S. PATENT DOCUMENTS

| | | | |
|---|---|---|---|
| 2,273,732 | 2/1942 | Quisling | 24/205.15 R |
| 3,847,188 | 11/1974 | Auer et al. | 24/205.16 C |
| 3,880,203 | 4/1975 | Frohlich | 139/384 B |
| 4,000,546 | 1/1977 | Takamatsu | 24/205.15 R |

*Primary Examiner*—Henry S. Jaudon
*Attorney, Agent, or Firm*—Karl F. Ross

[57] ABSTRACT

A slide fastener comprises a pair of tape-like units each secured to one edge of an article whose edges are to be connected by movement of a slider along the units. Each tape-like unit comprises a row of interconnected coupling elements formed by a synthetic-resin monofilament, each coupling element having an eye or loop-shaped portion deformed to constitute the coupling head which can be received between coupling heads of the other row. From the eye-forming monofilament segments, shanks extend across the tape-like unit and are received in pockets of a multiplicity of longitudinal threads (e.g. as the weft of a weave in which the longitudinal threads form the warp, or in courses of the warp knit in which the longitudinal threads are loop chains). The slider has a pair of channels which merge into a common channel, the transition zone between the pair of channels and the common channel being superimposed to press the coupling heads of one row between the coupling heads of the other generally perpendicularly to the slide-fastener plane.

9 Claims, 14 Drawing Figures

SLIDE FASTENER

CROSS-REFERENCE TO RELATED APPLICATIONS

This application is related to commonly assigned, concurrently filed copending application Ser. No. 722,265, Ser. No. 722,339, and Ser. No. 727,047.

FIELD OF THE INVENTION

The present invention relates to a slide fastener assembly comprising a slide fastener stringer and a slider, especially for so-called concealed slide fasteners or invisible slide fasteners in which the article to which the slide fastener is secured normally has a pair of confronting edges in abutting or close relationship.

BACKGROUND OF THE INVENTION

As has been described in the aforementioned applications, a slide fastener stringer generally comprises a pair of support tapes along confronting edges of which are provided rows of coupling elements which are interdigitable upon movement of a slider along these rows. In one construction which has recently found considerable favor in the art, each row of coupling elements is constituted by a substantially helical coil of a synthetic-resin monofilament, the turns of each coil being constituted as the coupling element. One side of each turn may be deformed to provide protuberances along the axis of the coil which engage with corresponding protuberances of the other coil for interlocking of the coupling elements with one another. The turns run immediately into bights which interconnect the shanks of the successive turns. The slider can be guided along these coils which can be provided with a filler core and can be stitched between the turns to the tape.

Numerous other systems utilizing basically similar principles have been proposed. For example, the turns can be fitted through openings in a knit or woven tape so that the textile threads of the tape are interposed between the turns. The coils can be replaced by so-called meanders which have an undulating configuration and can be anchored to the tape by any of the techniques described above.

A common disadvantage of all such systems is, of course, the fact that the pitch or turn spacing of the slide fastener row tends to vary with various effects adapted to modify the support tape or the threads connecting the coils to the support tape. For example, shrinkage by heat or moisture during washing of the garment, chemical action during dry-cleaning, environmental attack and the like, all are capable of modifying the parameters of the textile threads disposed between the turns of the coupling rows and hence varying the pitch of the heads.

The above-described applications, of which the present case is in part a collateral advance, recognize that some of these problems, if not all of them, can be eliminated by forming the coupling elements as part of tape-like support structures or units from which the coupling heads project along one lateral edge while the shanks are extended into pockets formed by longitudinal threads to form part of the weft or the exclusive weft for a multiplicity of such longitudinal threads. Because a shank of each coupling head or a pair of mutually abutting shanks of each coupling element are disposed in the successive pockets formed by the longitudinal threads, considerable stability is imparted to the structure and many of the disadvantages enumerated above are eliminated.

The invention in the present case is directed to a combination of the stringer with the slider and deals with problems which arise when the conventional coupling elements as described are used with a conventional slider. A slider generally comprises a shield-forming channel for the respective rows of coupling elements, these channels merging into a common outlet channel at one end of the slider. At the other end of the slider and centrally thereof there is provided a heart piece or divider which spreads apart the coupling elements of the two rows for the opening movement of the slider.

Thus the present disclosure deals with a slide fastener whose coupling rows are formed from synthetic-resin monofilaments with coupling elements formed with eyes having coupling heads pressed therein, eye-forming monofilament segments extending to either eye of the coupling heads, connecting shanks extending from these segments and bight portions connecting the shanks of adjoining coupling elements, the shanks forming part of a weft of a support structure from which the bights project. The slider which cooperates with the rows of coupling elements has a shield and channels in which the rows are guided with a divider or heart piece extending from one side of the slide fastener to the other.

Prior-art sliders have not been entirely successful although they have been constructed in various configurations to solve different problems. For example, many earlier stringers did not have a highly stable coil or row of coupling elements and the inerhead spacing or pitch did not remain constant for the reasons noted above and because the head spacing was effected adversely by the diverse method of attaching the stringer to the garment or other article. During the stitching process and as a consequence of the stitching process variations were discovered in the head spacing which detrimentally effected the ability to open and close the fastener by the movement of the slider therealong. These disadvantages were in addition to the shrinkage, stretching and distortion effects mentioned earlier. In fact, the changes did not take place equally in both slide-fastener halves so that is was not uncommon to find that the interhead spacing of one slide-fastener half, after some use of the garment, several washings or the like differed markedly from the interhead spacing of the other slide fastener half. In these cases the slide fastener became unusable.

Furthermore, especially where the garment or other article to which the rows of coupling elements were secured had closely confronting edges, one could not readily draw the slider between them without entraining the fabric with the slider so that difficulties were encountered during the fastening and unfastening process as well.

There are two techniques which have been used for interdigitating the rows of coupling elements known in the art. The first can be denominated as a coupling by spreading. In this technique, the two rows of coupling elements are maintained in the same plane, i.e. in the slide fastener plane, and the rows are bent to spread apart the adjoining copending elements so that the head of one coupling element can fit between the heads of the opposing pair of coupling elements by movement in the spreading plane. As a practical matter, the spreading of the adjacent coupling elements to accommodate the heads of the opposite elements must be considerable and hence the slider was required to have a relatively wide mouth and, consequently, a large opening angle. The article to which the coupling elements were secured resisted such spreading to an extent which depended upon the way in which the stringer was stitched to the article. In many cases, therefore, such sliders were impractical and considerable case had to be taken to ensure that the method of attachment would not be contrary to the requirements for the particular slider. Such strictures could not be observed in many instances because potential users often had to use different types of sewing machines and the like.

In the other type of interdigitation (press fitting), the coupling rows were not bent into a V-shaped configuration in a single plane but were superposed. In other words one of the coupling rows was brought into a second plane which generally lay above the slide fastener plane, the coupling elements of this row being pressed downwardly between the coupling elements of the other row. This slider requires means or special design characteristics to prevent it from being induced to slide along and open the fastener when a transverse stress is applied.

OBJECTS OF THE INVENTION

It is the principal object of the present invention to provide a slide fastener which can be readily attached, e.g. by stitching, to an article such as an article of clothing, whereby the sewing operation does not affect the interhead spacing.

Another object of the invention is to provide an improved slide fastener utilizing in part the principles set forth in the aforementioned coupling applications and having advanced cooperation with a slider.

Still a further object of the invention is to provide a slide fastener assembly including a stringer and a slider with greater dimensional stability, facility of operation and freedom from a tendency to break down than earlier slide fastener arrangements.

SUMMARY OF THE INVENTION

These objects and others which will become apparent hereinafter are attained, in accordance with the present invention, with a slide fastener having a support structure or tape-like unit in the aforementioned applications which limits the spreadability of the coupling elements so that this spreadability is limited to a free distance of the eye-forming monofilament segments in the spread (directly connected to the coupling head) which corresponds approximately to the width of the coupling head measured in the longitudinal direction of the coupling element. According to an essential feature of the invention the slider is provided at its slider or heart piece with material-deflecting flanges which divert the edges of the garment or other article to which the slider fastener is attached away from the path of the slider, the slider being internally configured for a press fitting of the coupling elements together, i.e. the thrust of a coupling element between coupling elements of the other row in a direction transverse to the plane of the slide fastener.

According to a preferred embodiment of the invention, the pressure-coupling slider comprises a pair of mutually parallel guide channels for the respective slide fastener strips, these channels running in the direction of the slide fastener longitudinal axis and having a tuning fork configuration in a projection parallel to the slide fastener plane and orthogonal to the longitudinal axis of the slide fastener, i.e. a projection in a plane perpendicular to the slide fastening plane and including the axis. The tuning fork comprises a pair of parallel leg sections, a trunk section and inclined transition sections between each leg section and the trunk section. The divider formed as a connecting web disposed in the region of the leg sections and ahead of which the inclined transitions terminate.

The tuning fork configuration of the guide channels for the slide fastener strips makes it possible to so shape the connecting web that it has the characteristic described above. The feature whereby the connecting web terminates ahead of the inclined transition sections is advantageous in that the two parallel leg sections can feed the coupling rows on to one another and further that it allows with great ease the slider to be applied at one end of the stringer to the connected coupling strips. Of course this greatly facilitates application of the slider to the stringer which is advantageously fabricated in a closed condition. Moreover, the channels which accommodate the strips facilitate an easier and more reliable displacement of the slider so that the latter can be displaceable more rapidly and bring about faster opening and closing of the slide fastener without failure of missing of the interfitting of the coupling elements.

The term "spreadability", as it applies to the present invention is used to denote the ability to spread apart successive coupling heads of each row as seen in projections of the coupling heads upon the slide fastener plane. The spreading is effected by an arcuate guiding of the rows of coupling elements or strips in the channels of the slider.

According to an important feature of the invention, this spreading is limited to avoid distortion of the coupling elements by carrying out the interconnection by press fitting along the principles described but with slight spreading of the coupling element as viewed in projection on the slide fastener plane. The invention takes into consideration the fact that the tape-like unit or support structure renders the interhead spacing of the rows of coupling elements fully determinate under all conditions and independent from the sewing seams and stitching operation whereby the slide fastener strips are attached to the garment or other articles. Of course this clearly limits the spreadability and ensures that the coupling strips will assume their original positions even if they have been slightly deformed to provide a spreading as seen in projection upon the slide fastener plane. No difficulties arise, moreover, because the slider has two guide channels, each of which can accommodate the entire strip and the channels are designed to force the coupling heads of one row between the coupling heads of the other row in a direction transverse to the plane of the slide fastener and hence the planes of the two coupling strips. The fabric-deflecting flanhes prevent the material to which the strips are attached from being entrained with the slide and disrupting the opening and closing movement thereof.

Of course, an important aspect of the invention is the tape-like unit or support structure which constitutes the slide fastener half guided entirely through the slider in accordance with the invention. Details of the tape-like units may be found in the aforementioned applications although a brief description of most suitable units is given below.

Thus in a preferred embodiment the tape-like unit comprises longitudinal threads running in the longitudinal direction of the slide fastener and which can form warp threads of a weave or looped chains of a warp knit. The shank of the coupling elements can extend through pockets in the warp, e.g. the warp threads of a weave can cross over some opposite side between the shanks of the coupling elements or between pairs of shanks thereof. When the unit is a knit, the shanks or pairs of shanks may extend through common courses of the knit. Hence the spreadability of the coupling elements, whose shanks act as all or part of the inlaid weft of the unit is clearly restricted.

Several low-stretch threads can form part of the longitudinal thread group or warp of the systems.

The advantage of reducing the spreadability to approximately the width of the coupling head, as measured in the longitudinal direction of the slide fastener, ensures the pressed fitting of each coupling head between the two coupling heads of the other row without difficulty. Since the coupling elements of the present invention are elastically deformable especially when they are of relatively thin monofilament threads with a diameter of, for example, 0.5 mm, the spreadability can be so limited that the free space of the eye-forming monofilament segments is slightly smaller than the width of the coupling heads. The result, therefore, is a spring locking and release of the coupling heads with movement of the slider.

It is important in accordance with the present invention to ensure that the slide fastener will accurately guide the slider and be received therein. In other words play between the slider and the coupling strips should be minimized. Accordingly the invention provides that the height of the guide channels of the slider should substantially conincide with the thickness of the coupling strips in the regions in which the coupling strips are enclosed by these channels. Moreover, the coupling eyes may be received in portions of the channel of substantially the same height and defined between the inner surface of the fabric-deflecting flanges and the opposite side of the channels.

At the slider mouth the separation of the two strip channels is held as small as possible and preferably is only as great as the height of the coupling heads with respect to the slide fastener plane, i.e. this spacing is equal to the minimum necessary to ensure separation of the interdigitated coupling head. Of course, the slider must be able to accommodate the stitching thread which applies the respective strips to the article and, if provided with the configuration described above, can be readily fitted onto the strips when the latter are stitched in place. In the simplest case the slider may be formed between the lower flange and the fabric-deflecting flanges with a groove or channel within the stitching seams can pass. The longitudinal thread can form loop shanks of a knit, the shanks of the coupling element being received within courses of the knit as an inlaid weft.

The system of the invention has the advantage that the sewing operation which attaches the strips to the garment or other article cannot change the interhead spacing because the coupling element is held with full dimensional stability in its tape-like unit or support structure. The slide fastener, after having been sewn in place, is highly flexible and the reduced spreadability ensures reliable operation. Of course, for the reasons already given, slider mounting is also facilitated.

BRIEF DESCRIPTION OF THE DRAWING

The above and other objects, features and advantages of the present invention will become more readily apparent from the following description, reference being made to the accompanying drawing, in which.

SPECIFIC DESCRIPTION

Figure 1:
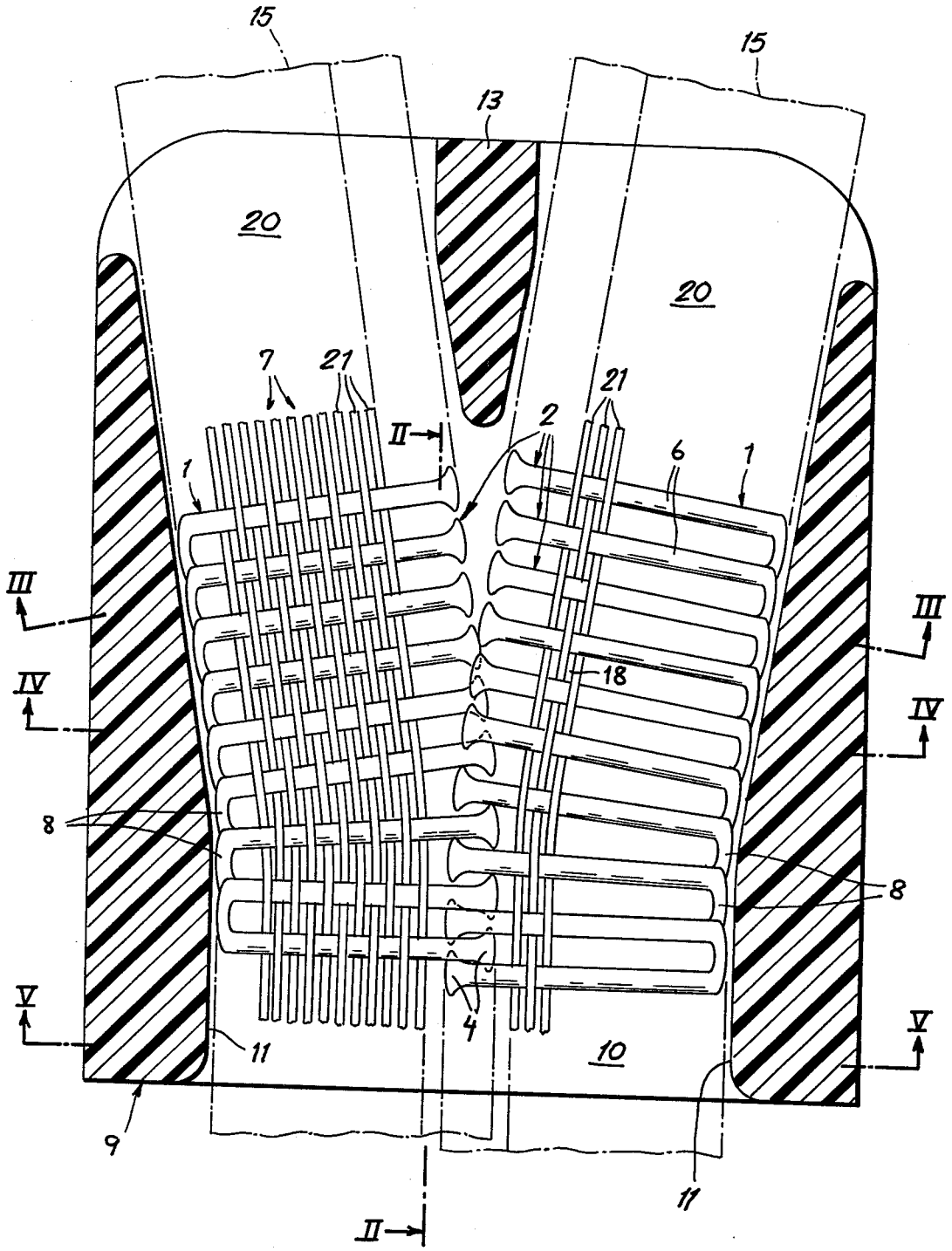
FIG. 1 is a diagrammatic section, taken parallel to the plane of a slide fastener, through a slider on a slide fastener embodying the invention, the system being shown greatly enlarged over the actual size.

FIGS. 1–5 and 7 show a slide fastener which comprises a pair of rows 1 of coupling elements formed from synthetic-resin monofilament (generally polyester or nylon), each of these rows comprising coupling elements 2 whose coupling heads 4 are provided with lateral protuberances on coupling eyes or loops 3. The coupling eyes or loops 3 are formed by opposite monofilament segments 5 of arcuate configuration and connecting shanks 6 which extend from these segments 5 away from the coupling heads.

The shanks 6, as described more fully in the above-identified copending applications and as shown in the present drawing, lie next to one another for each coupling element and abut one another within respective pockets of the support structure formed by these shanks and a multiplicity of longitudinal threads 21.

The support structure is represented diagrammatically at 7 and as the coupling eyes 3 projecting laterally there from along a confronting edge of the support structure. This confronting edge of the support structure is locked to the confronting edge of the opposing support structure by the movement of a slider therealong as described hereinafter.

The shanks of adjoining coupling elements are interconnected by bights 8 which lie along the lateral edges of the support structures 7 and form guides or rails along which the slider 9 is displaced.

The slider 9 comprises a unitary upper shield 10 formed with a pair of laterally overhanging flanges 12 which underlie the support structures 7 and define with the upper shield 10 channels in which the support structures are guided or received.

Figure 4:
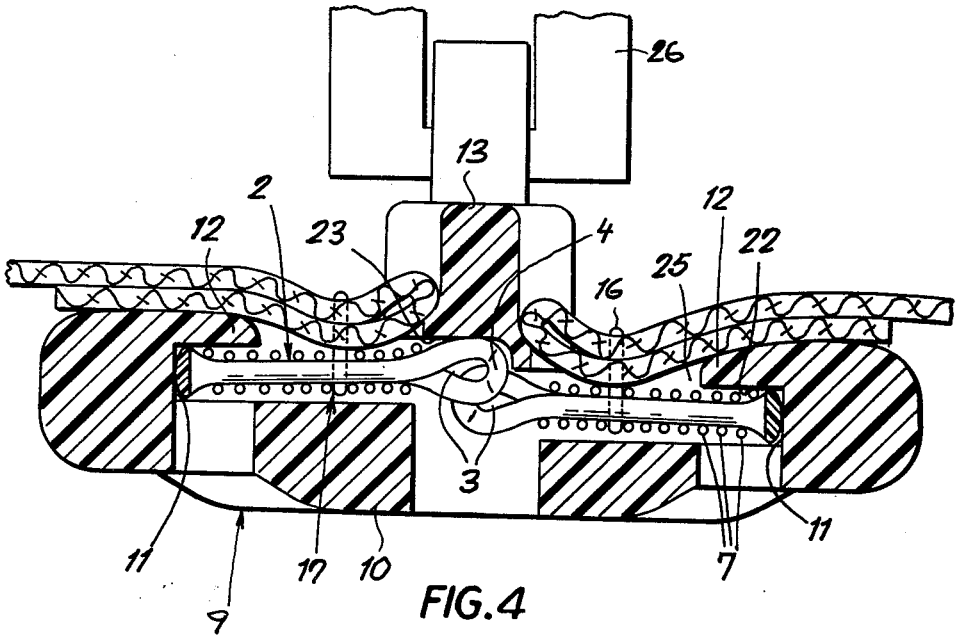
FIG. 4 is a section taken along the line IV — IV of FIG. 1.

The channels are formed with the lateral guide surfaces 11 which, as can be seen from FIG. 4, for example, slide along the outer surfaces of the bight 8.

Close to the mouth of the slider there is provided a heart piece or divider 13 which lies centrally of the slider and extends from the shield 10 to the opposite side thereof.

Figure 5:
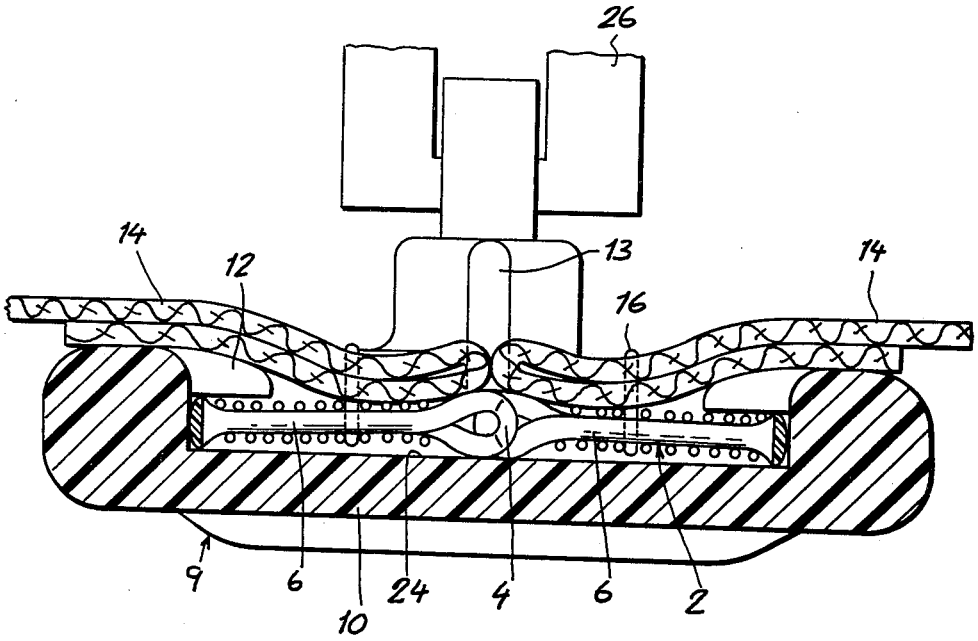
FIG. 5 is a section taken along the line V — V of FIG. 1.
Figure 6:
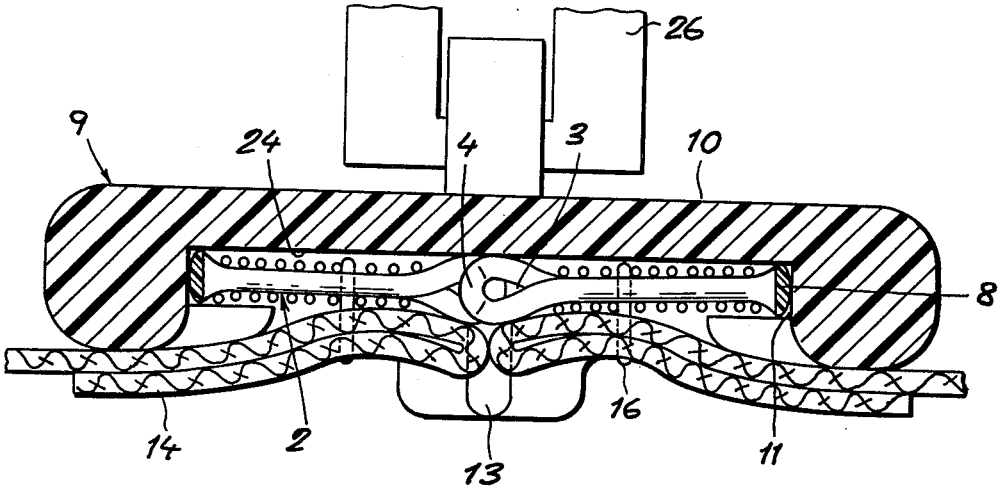
FIG. 6 is a section corresponding to FIG. 5 of another embodiment of a slide fastener and slider arrangement according to the invention.
Figure 7:
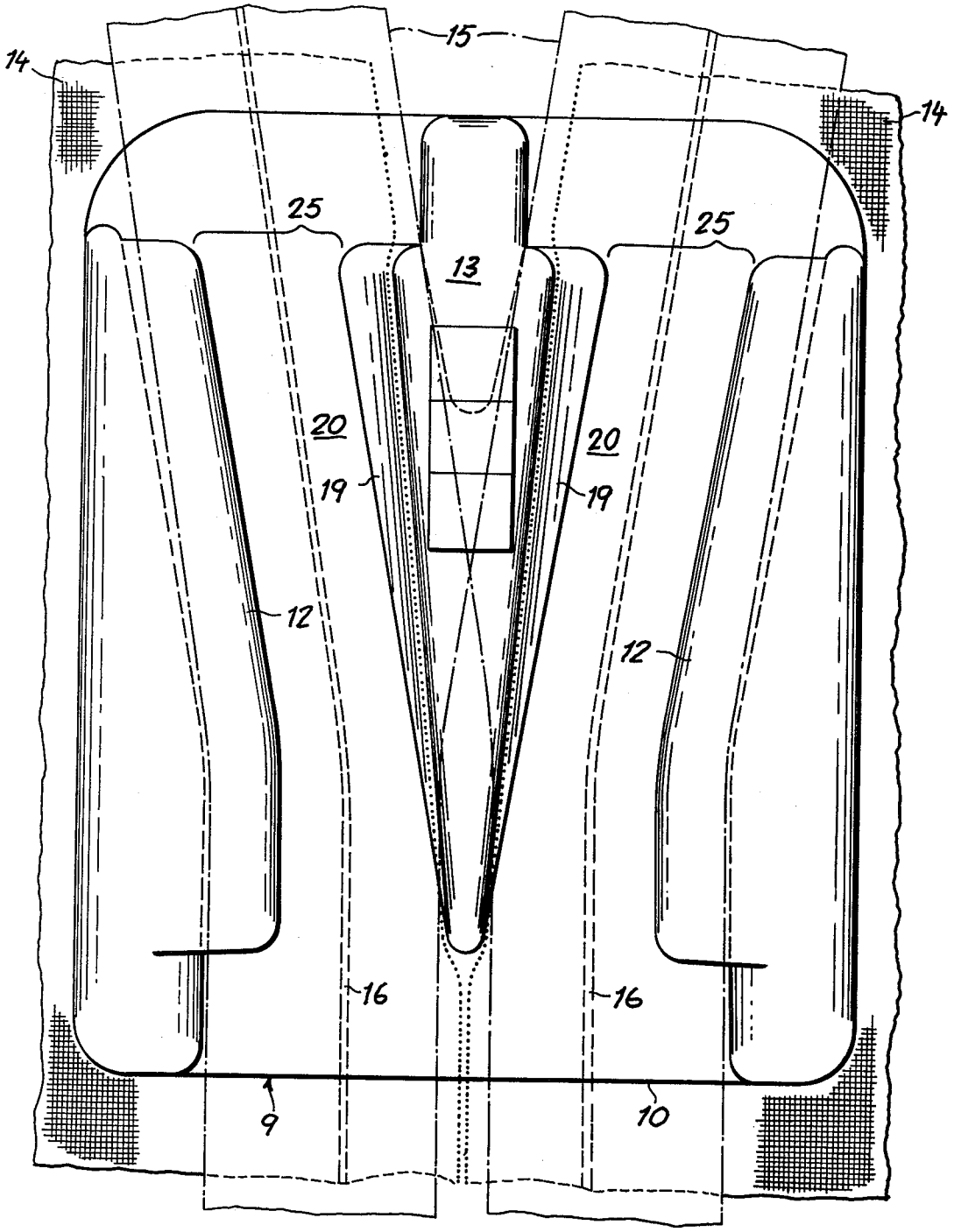
FIG. 7 is a plan view of the slider and slide-fastener arrangement, parts of the latter being shown diagrammatically, of the system of FIG. 1.
Figure 8:
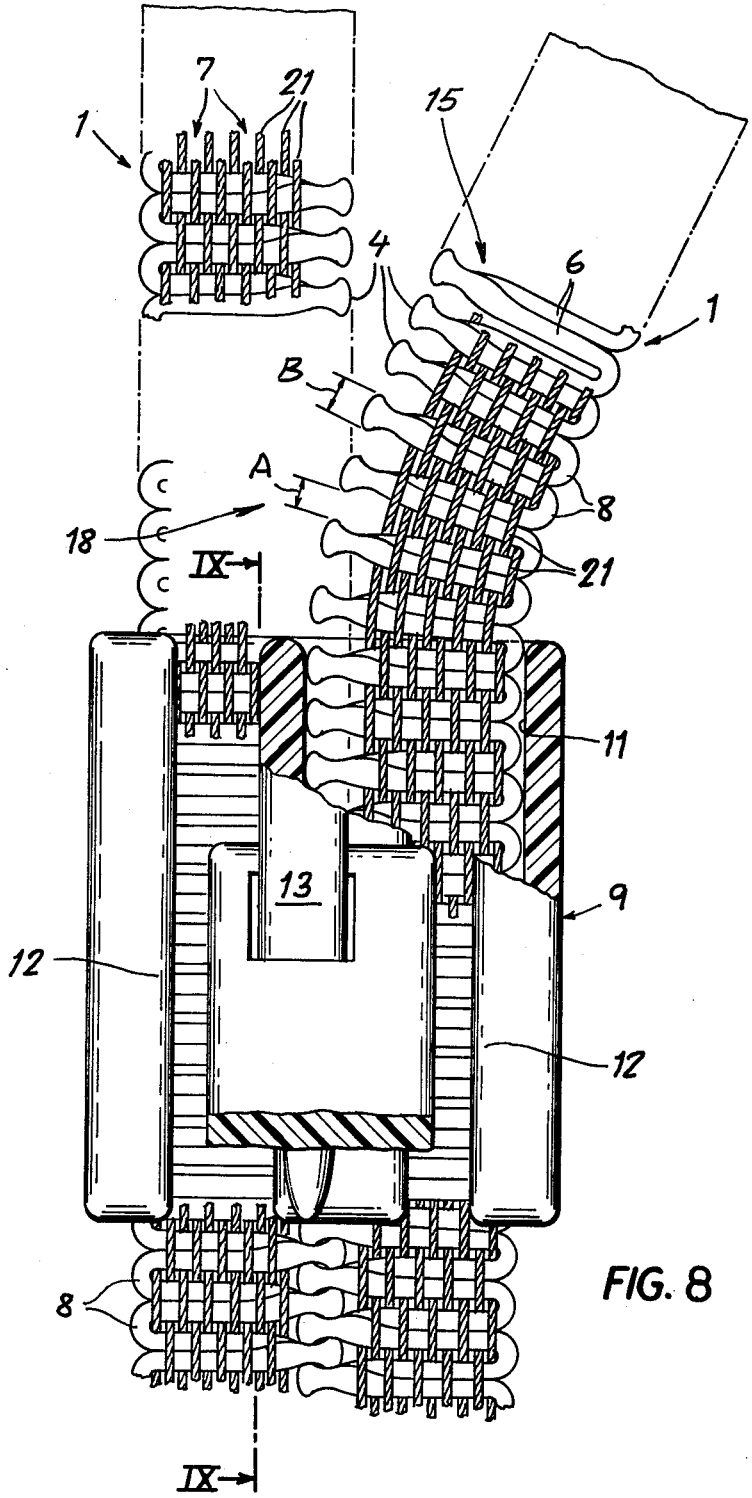
FIG. 8 is a plan view of another embodiment of a slide fastener and a slider according to the invention, partly broken away and partly in diagrammatic form.

Of course, as a comparison of FIGS. 1–5 with FIG. 6 will show, the upper shield 10 of the slider can be provided at the same side as the handle 26 or at the slide opposite the handle 26, provided that it directly overlies the coupling strips 7 which are to be joined together or separated by this slider. In FIG. 5, for example, the shield 10 overlies the coupling strips 7 from the underside of the fabric 14 while in FIG. 6, the coupling strip can be applied to the exposed surface of the fabric and the slider is displaceable along this side.

The strips 15 are secured to the garment 14 by rows 16 of stitching, the stitches of the rows engaging around the shanks 6 as can be seen at 17 in FIGS. 1–6.

In the system of the present invention, the spreadability of the coupling elements 2 is limited by the support structure 7. This spreadability is represented at 18 in FIG. 1.

According to the invention, the spreadability is limited to a free space A between the eye-forming monofilament segments 5 which is slightly less than the width B of the coupling heads as measured in the longitudinal direction of the slide fastener.

These measurements are given as seen in projection upon the slide fastener plane in the spread state of the coupling elements 2, i.e. with a V-shaped orientation of the coupling strips 15.

The slider 9 has its divider formed with fabric deflecting flanges 19 which will be discussed in greater detail below, these flanges serving to delfect the edges **14*a* of the garment away from the eyes 3** and rearwardly as the slider is shifted along the slide fastener.

The divider 13 subdivides the interior of the slider 20 (in the region of the divider) into two guide channels 20 for the respective strips 15, these channels being oriented for press interfitting of the two rows of coupling elements. Press interfitting is of course used herein to describe the process whereby the coupling elements of one row are pressed between the coupling elements of the other row in a direction transverse to the plane of the slide fastener.

In FIGS. 1–6 and, in accordance with the preferred embodiment of the invention, the tape-like unit or support structure 7 is formed with longitudinal threads 21 of textile fibers which can be warp threads of a weave in which the shanks 6 form the weft and are received in pockets of the warp. Alternatively, the longitudinal threads 21 can represent loop chains of a warp knit whose courses receive the respective shanks 6. This configuration strictly limits the spreadability of the coupling elements.

As noted, it is a preferred embodiment of the invention to constitute the shanks 6 as weft threads interwoven with the longitudinal or warp threads 21.

Since the synthetic-resin monofilament can have a relatively small diameter, e.g. about 0.5 mm, the elastic deformability of the coupling elements 2 can be used to facilitate the press-fitting of the heads. In this case the free space A can be slightly less than the width B of the coupling head 4. When the coupling elements are more rigid, however, and the elastic deformability of the coupling element cannot be considered, the free space A should be equal to the width B of a coupling head.

Figure 3:
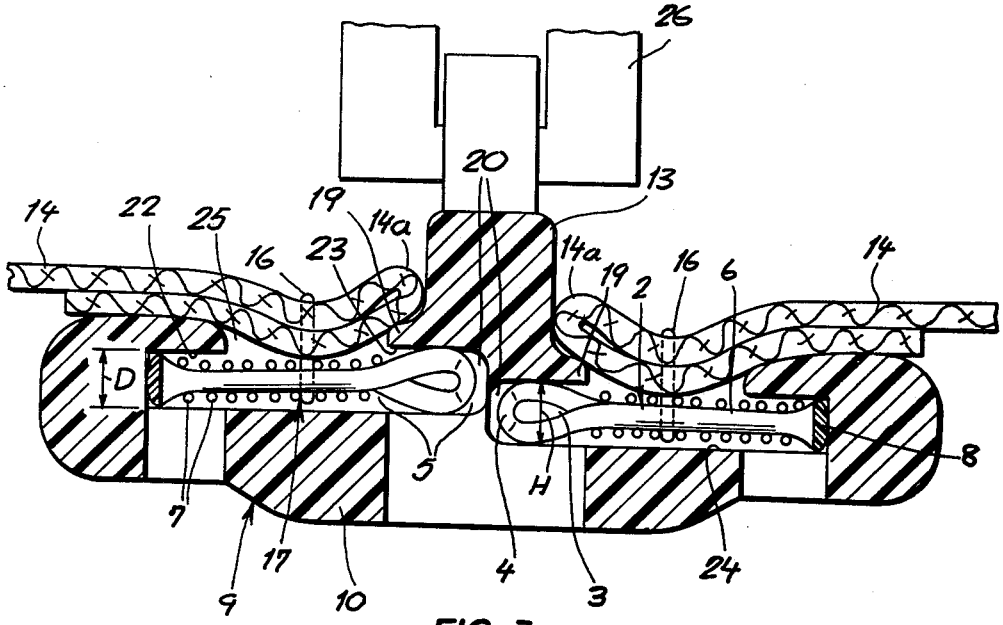
FIG. 3 is a section taken along line III — III of FIG. 1.

As FIGS. 3–5 make clear, the guide channels 20 conform in thickness or height D and H, respectively, to the thickness of the slide-fastener strips 15 in the region of the shanks 6 and the thickness in the region of the coupling eyes 3 and the coupling heads 4. These dimensions on the slider are defined between the inner surface 22 of the overhanging flanges 12 and the undersides 23 of the fabric-deflecting flanges 19, respectively, and the inner surface 24 of the shield 10.

Between the inner edges of the overhanging flanges 12 and the fabric-deflecting flanges 19, there are provided throughgoing slots 25 which clear the stitch seams 16. These slots are especially apparent in FIG. 7.

The handle 26 for actuating the slider can be anchored directly to the divider 13 and hence can be provided on the side thereof remote from the shield 10 or can be provided directly upon the shield as a comparison of FIGS. 5 and 6 will reveal. This only depends upon whether the slider is to be of the so-called invisible typetype (FIGS. 1–5 and 7) in which the edges **14*a* of the fabric come together to conceal the slide fastener, or of the freely visible type (FIG. 6) wherein the coupling strips 15** are visible from the side at which actuation takes place.

FIGS. 8–14 describe a particularly advantageous embodiment of the invention which, however, is basically similar to that of FIGS. 1–7 and hence similar reference numerals have been used to designate similar structure.

Thus the rows 1 of coupling elements 2 are composed of synthetic-resin monofilaments, the coupling elements having coupling eyes 3, coupling heads 4 whose formations project from the coupling eyes, eye-forming monofilament segments 5 and shanks 6 which extend the full width of the coupling strips 15. As described particularly in the copending application Ser. No. (attorney's docket No. 9891), however, the shanks 6 of each coupling element are not superposed relationship (see FIGS. 1–7 ) but rather lie side-by-side in mutually abutting relationship in a plane corresponding to the slide fastener plane. As in the case of the superimposed shank arrangement of FIGS. 1–7, the shank of FIGS. 8–11 form a double weft interwoven with the warp filaments 21. The eyes 3, however, lie in planes perpendicular to the slide fastener plane so that the loop or eye-forming segments 5 are superposed in the region of the heads so that they have common projections, for each coupling element, in the plane of the slide fastener. The bights extend out of each warp pocket containing two shanks and into the next warp pocket. Instead of the shield arrangement shown in FIG. 10 which is equivalent to that of FIG. 5, the shield can be provided as shown in FIG. 6, i.e. reversed with respect to the handle or grip.

Figure 2:
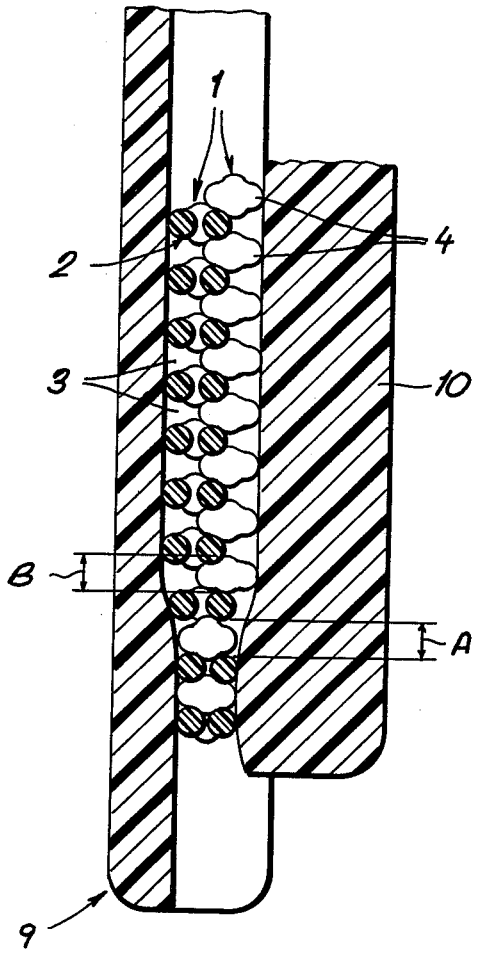
FIG. 2 is a section taken along the line II — II of FIG. 1.
Figure 9:
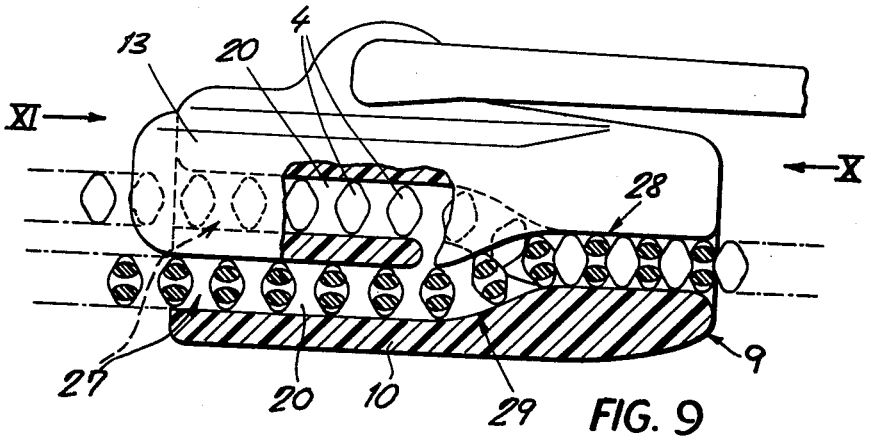
FIG. 9 is a section taken along the line IX — IX of FIG. 8.
Figure 10:
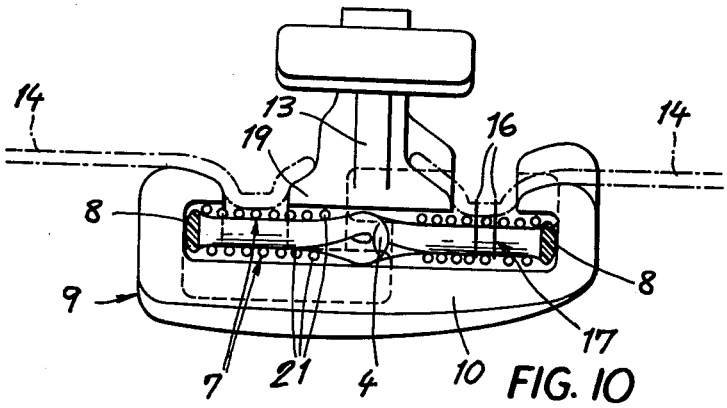
FIG. 10 is a view of the slider of FIGS. 8 and 9 taken in the direction of arrow X in FIG. 9.
Figure 11:
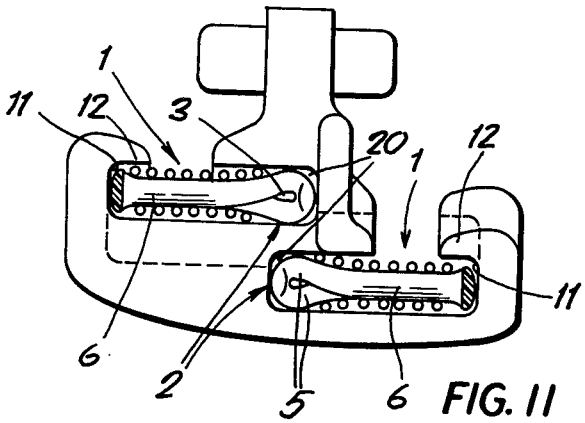
FIG. 11 is a view of the arrangement shown in FIGS. 8–10 but taken in the direction of arrow XI of FIG. 9.
Figure 12:
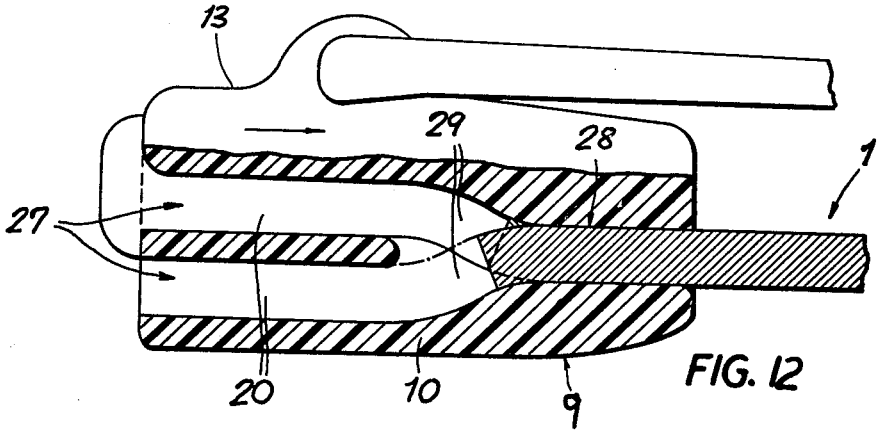
FIGS. 12–14 are diagrammatic longitudinal sections illustrating the insertion of the slider on the slide fastener and the movement thereof from the beginning of the stringer toward the end thereof.
Figure 13:
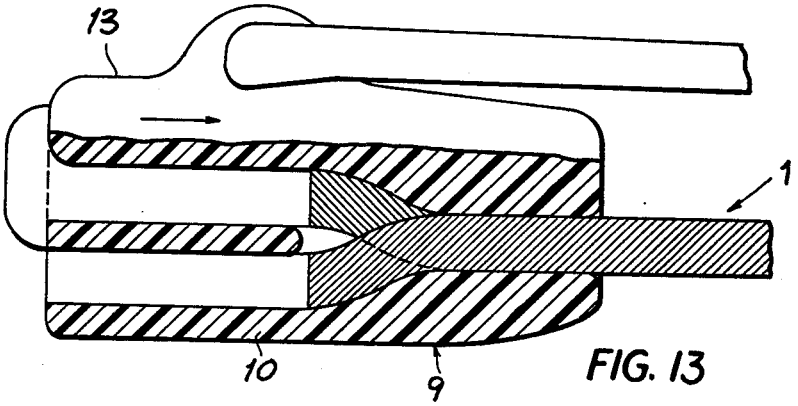
Figure 14:
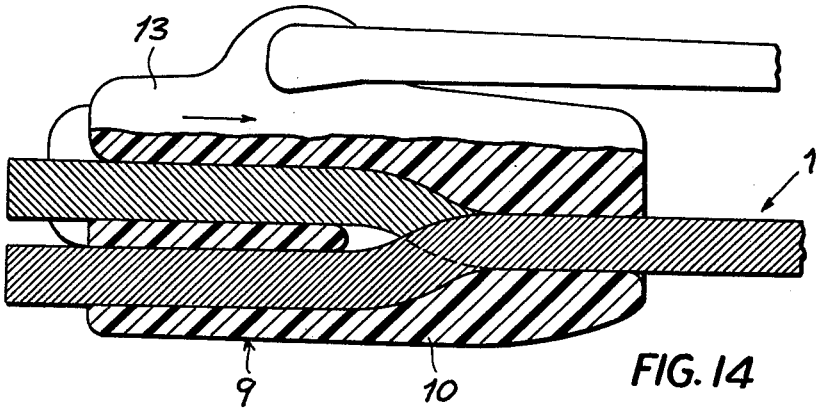

In this embodiment as in the embodiment of FIGS. 1–5, the leg sections 27 of the channels are parallel and merge into a trunk section 28 at inclined transition sections 29 so that the channels have a tuning fork configuration as seen in projections on a plane corresponding to the plane of the paper in FIGS. 2 and 9 and hence in a plane perpendicular to the slide-fastener plane but parallel to the axis of the slide fastener. This, of course, permits the slider (FIG. 12) to be fed into the slide fastener through the trunk channel 28 and gradually moved along until separation of the coupling elements begin (FIG. 13), the normal opening movement being then effected as shown in FIG. 14.

We claim:

1. A slide fastener comprising, in combination:

a pair of tape-like support units each comprising a continuous monofilament row of coupling elements, each coupling element having a loop-forming eye provided with a coupling head, a pair of eye-forming monofilament segments on opposite side of said head, connecting shanks extending from said segments and bights spaced from said head and connecting shanks of adjacent coupling elements, and longitudinal threads forming pockets receiving said shanks, said heads projecting along one edge of each unit; and a slider shiftable along said units for interdigitating and separating the coupling heads of said rows, said slider comprising a shield lying along one side of said units, a pair of flanges overhanging the other side thereof and connected to said shield, and a divider, said slider defining in the region of said divider respective channels adapted to receive each of said units and oriented to press the heads of one of said rows between the heads of another of said rows in a direction transverse to the slide fastener plane, said units being so constructed and arranged that the spreadability of said coupling elements is limited to a free spacing of said segments of adjacent coupling elements which corresponds approximately to the width of said head as measured in the longitudinal direction of the slide fastener.

2. A slide fastener comprising, in combination:

a pair of tape-like support units each comprising a continuous monofilament row of coupling elements, each coupling element having a loop-forming eye provided with a coupling head, a pair of eye-forming monofilament segments on opposite sides of said head, connecting shanks extending from said segments and bights spaced from said head and connecting shanks of adjacent coupling elements, and longitudinal threads forming pockets receiving said shanks, said heads projecting along one edge of each unit; and a slider shiftable along said units for interdigitating and separating the coupling heads of said rows, said slider comprising a shield lying along one side of said units, a pair of flanges overhanging the other side thereof and connected to said shield, and a divider, said slider defining in the region of said divider respective channels adapted to receive each of said units and oriented to press the heads of one of said rows between the heads of another of said rows in a direction transverse to the slide fastener plane, said units being so constructed and arranged that the spreadability of said coupling elements is limited to a free spacing of said segments of adjacent coupling elements which corresponds approximately to the width of said head as measured in the longitudinal direction of the slide fastener, each of said units being stitched to a fabric article by a respective row of stitching along an edge of the article, said divider being formed with fabric-deflecting flanges spaced above said shield and urging said edges away from one another upon movement of said slider along said units.

3. The slide fastener defined in claim 2 wherein said longitudinal threads are warp threads of a weave and said shanks are received in pockets formed by said warp threads, said warp threads crossing between said shanks and said shanks forming the weft of said units.

4. The slide fastener defined in claim 2 wherein the spreadability of said elements permits a free spacing of said segments of adjacent coupling elements limited to less than said width.

5. The slide fastener defined in claim 2 wherein said channels have heights along the shanks and eyes of said units defined between said shield and said inwardly turned and fabric-deflecting flanges, respectively, corresponding to the thicknesses of said units in the corresponding regions of these channels.

6. The slide fastener defined in claim 2 wherein said channels form in a projection in a plane parallel to the axis of the slide fastener but perpendicular to the plane thereof a tuning fork shaped with mutually parallel leg sections respectively receiving said units, a trunk section, an inclined transition section interconnecting said leg sections with said trunk section, said divider being disposed between said leg section and terminating ahead of said transition sections.

7. The slide fastener defined in claim 6 wherein said bights form ridges along the outer edges of said units slidably engaging walls of said channels.

8. The slide fastener defined in claim 7 wherein both shanks of each coupling element lie in a respective pocket formed by said longitudinal threads as a double weft.

9. The slide fastener defined in claim 8, wherein said inwardly turned flanges and fabric-deflecting flanges define gaps between them through which the stitching seams extend.

* * * * *